United States Patent [19]

Krueger et al.

[11] 4,338,997

[45] Jul. 13, 1982

[54] HEAT EXCHANGER WITH BILAYERED METAL END CONTAINER FOR ANTICORROSIVE ADDITION

[75] Inventors: Robert H. Krueger, Palatine; John L. Zambrow, Lincolnshire, both of Ill.; Brian E. Cheadle, Bramalea, Canada

[73] Assignee: Borg-Warner Corporation, Chicago, Ill.

[21] Appl. No.: 222,456

[22] Filed: Jan. 5, 1981

[51] Int. Cl.[3] ..... F28F 19/00

[52] U.S. Cl. ..... 165/134 R; 220/455; 222/54; 428/651

[58] Field of Search ..... 428/571–573, 428/651, 660, 661, 937, 934, 938; 222/54; 220/453, 455; 165/133, 134 R

[56] References Cited

U.S. PATENT DOCUMENTS

| | | | |
|---|---|---|---|
| 2,726,436 | 12/1955 | Champion | 428/654 |
| 2,797,174 | 6/1957 | Mozley et al. | 428/654 |
| 2,993,269 | 7/1961 | Kelley | 428/651 |
| 2,995,808 | 8/1961 | Weisse | 428/654 |
| 3,359,142 | 12/1967 | Ward, Jr. | 428/651 |
| 3,393,446 | 7/1968 | Hughes et al. | 428/652 |
| 3,496,621 | 2/1970 | Winter | 428/651 |
| 3,551,247 | 12/1970 | Feakes | 428/651 |
| 3,717,915 | 2/1973 | Teubler et al. | 428/654 |
| 3,857,973 | 12/1974 | McKee et al. | 428/654 |
| 3,963,143 | 6/1976 | Anderson et al. | 428/654 |
| 4,197,360 | 4/1980 | Throop | 428/651 |
| 4,268,586 | 5/1981 | Hanneman et al. | 428/673 |

FOREIGN PATENT DOCUMENTS

| | | | |
|---|---|---|---|
| 163374 | 6/1955 | Australia | 428/651 |
| 897615 | 4/1972 | Canada | 220/DIG. 30 |
| 873341 | 4/1953 | Fed. Rep. of Germany . | |
| 522575 | 6/1940 | United Kingdom | 165/134 R |

*Primary Examiner*—Michael L. Lewis
*Attorney, Agent, or Firm*—James A. Geppert

[57] ABSTRACT

A membrane for the end surface of a container for a corrosion inhibitor for engine coolant where the membrane is exposed to the coolant and corrodes when the corrosiveness of the coolant increases above a predetermined level. The membrane is formed of the same metal or alloy as the radiator and has a thin layer thereon of a second metal except for certain areas where the base metal is exposed so that in a corrosive environment, a galvanic cell is set up between the two metals to enhance the rate of corrosion of the membrane.

8 Claims, 4 Drawing Figures

17
16
11
10
21
14
18
13
15
12

22
26
25
3.
3.
24
18

26
25

24
22
26
25
23
19

36

37
32
31
33
38
34
39
35

HEAT EXCHANGER WITH BILAYERED METAL END CONTAINER FOR ANTICORROSIVE ADDITION

BACKGROUND OF THE INVENTION

Engine coolants for the cooling system of an automotive vehicle generally contain ethylene glycol, alone or with a small percentage of diethylene glycol, and a suitable corrosion inhibitor. These inhibitors are usually a mixture of one or more inorganic salts, such as phosphates, borates, nitrates, nitrites, silicates or arsenates, and an organic compound, such as benzotriazole, tolyltriazole or mercaptobenzothiazole, to prevent copper corrosion. Similar inhibitors would be utilized to prevent aluminum corrosion. The solution is generally buffered to a pH of 8 to 10 to reduce iron corrosion and to neutralize any glycolic acid formed in the oxidation of ethylene glycol.

Over a period of time, the corrosion inhibitor in the coolant may be lost or at least decreased in concentration due to leakage, hose breakage or boil over, or the inhibitor may decrease in effectiveness due to age. If the corrosion inhibitor in the coolant decreases, metal corrosion will increase significantly. This is especially true for higher temperature coolant systems or where new lightweight aluminum radiators are substituted for conventional copper brass radiators.

In the copending U.S. patent application Ser. No. 88,506 filed Oct. 26, 1979, a container is disclosed which was suitably secured in a coolant line to the radiator with a corrodible end surface exposed to the coolant flowing through the line so that, if the coolant become corrosive, the end wall of the container would corrode through to release corrosion inhibitor in the container into the coolant system to reduce the corrosiveness of the coolant before corrosion of the radiator became a problem. For an aluminum radiator, the end wall of the container was formed of aluminum or an aluminum alloy, and the wall surface exposed to the coolant was scored or knurled to enhance localized corrosion.

However, although the end surface of the container will pit and corrode to allow liquid to enter and dissolve the corrosion inhibitor prior to serious corrosion of the radiator or other components of the cooling system, it would be desirable to speed up the corrosion process of the container surface to shorten the time interval between the coolant reaching the predetermined corrosive level and the point when the corrosion inhibitor is effectively released into the coolant. The present invention provides a container membrane which will act to shorten that time interval.

SUMMARY OF THE INVENTION

The present invention comprehends the provision of a corrosion inhibitor container having a membrane forming a wall surface that is susceptible to corrosion due to the corrosive level of the coolant contacting the membrane wherein, once corrosion of the membrane is initiated, the membrance corrodes rapidly from a resulting galvanic couple. The membrane is formed of a base layer of substantially the same material as the radiator to be protected from corrosion, and the base material is coated with a second material except for a limited area exposed to the coolant. Once the base material begins to corrode, the second material acts with the base material as a galvanic couple to enhance the rate of corrosion of the membrane.

The present invention also comprehends the provision of a novel membrane for a surface of a corrosion inhibitor container wherein an aluminum radiator is to be protected from corrosion. The base material of the membrane is aluminum or an aluminum alloy while the second material is a thin coating of titanium. The coating is scored or a portion of the base material is masked to prevent coating thereof. Thus, a limited area of the aluminum base material is exposed to the coolant and, once corrosion begins, the titanium-aluminum membrane results in a galvanic couple which speeds up corrosion of the membrane.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENT

Figure 1:
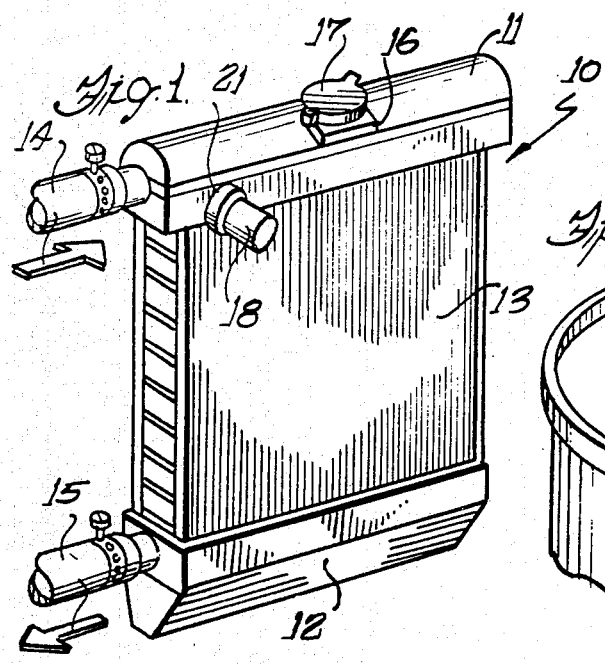
FIG. 1 is a perspective view of an automobile radiator with a corrosion inhibitor container positioned thereon.

Referring more particularly to the disclosure in the drawing wherein is shown an illustrative embodiment of the present invention, FIG. 1 discloses the radiator portion of an automotive vehicle cooling system including a radiator 10 having an inlet tank 11, an outlet tank 12 and a heat transfer core 13. A coolant inlet line 14 is connected to the tank 11, an outlet line 15 is connected to the tank 12, and a filler neck 16 communicates with tank 12 and has a pressure relief cap 17 to vent excess pressure to a suitable overflow (not shown).

Coolant comprising a mixture of ethylene glycol and water with a suitable corrosion inhibitor is circulated through the vehicle engine cooling system, wherein hot coolant from the vehicle engine cooling jacket flows through the inlet line 14 into the inlet tank 11, passes down through the radiator core 13 to be cooled by air flowing transversely through the core, and the cooled fluid exits from the outlet tank 12 through the outlet line 15 to the coolant pump (not shown) which forces the coolant back into the engine cooling jacket.

If the corrosion inhibitor concentration in the coolant should decrease below a predetermined level due to leakage or boiling over of the coolant or aging of the inhibitor, a container 18 filled with a charge of corrosion inhibitor 19 is suitably mounted in a fitting 21 on the side of the inlet tank 11. A membrane 22 seals one end of the container 18 and is exposed through the fitting 21 to the flowing coolant. This membrane is formed of a material similar to the material of the radiator 10, such that the corrosive quality of the coolant will act to corrode the membrane to allow release of the inhibitor in the container prior to any serious corrosion of the radiator. As disclosed in U.S. patent application Ser. No. 88,506, the membrane is formed of aluminum or an aluminum alloy when the radiator 10 is formed of aluminum, and the membrane is scored to provide a higher stressed area of the material so that corrosion will focus on the scored area.

Although this scored membrane is relatively thin so that it can be pierced to release the corrosion inhibitor 19 before any permanent corrosion damage is caused to the susceptible components of the coolant system, it must be strong enough to withstand the mechanical forces imposed on it by pressure and temperature changes, and by mechanical shock or fatique. Thus, although the aluminum foil membrane is effective for the intended purpose, it is desirable to speed up corrosion of the membrane under corrosive conditions to more quickly release the inhibitor into the coolant. To achieve this more rapid release, the membrane is formed as a bimetal.

Figure 2:
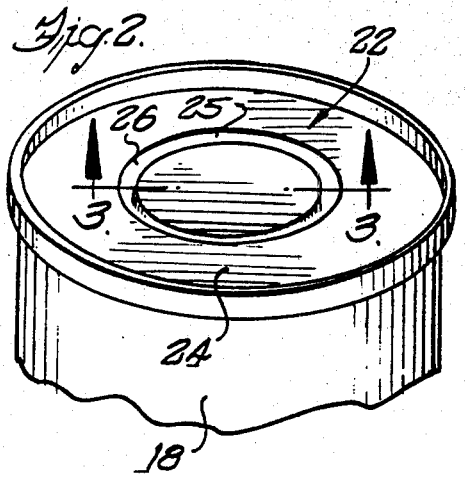
FIG. 2 is a partial perspective view of the corrosion inhibitor container with the novel membrane end surface.
Figure 3:
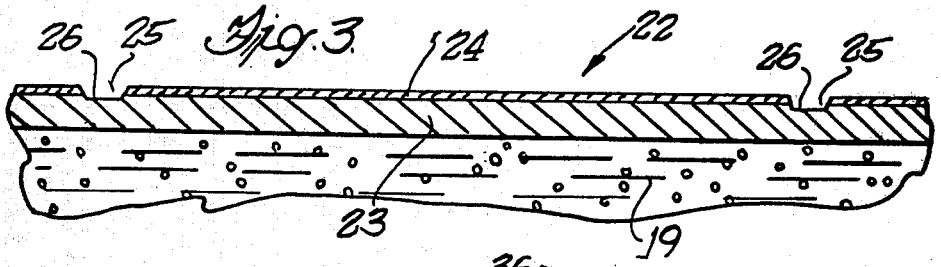
FIG. 3 is a partial cross sectional view through the membrane taken on the line 3—3 of FIG. 2.

The bimetallic membrane 22 comprises a base metal layer 23 of aluminum or an aluminum alloy, such as 1100 aluminum or 7072 aluminum. Depleted antifreeze, tap water, or water containing halide salts and heavy metal ions, as for example 300 ppm $Cl^-$ as NaCl and 1 ppm $Ch^{+2}$ as $CuCl_2$ will cause aluminum to corrode. The time of penetration (pitting) decreases with increasing salt or ion concentration. In addition, the penetration is dependent on the aluminum alloy composition and thickness. Generally, the corrosion rate decreases as the purity of the aluminum increases. A thin film 24 of titanium deposited on the base layer 23 will decrease the penetration time of the aluminum foil or membrane in corrosive water. To further enhance penetration of the membrane, a limited area 26 of the base metal 23 is exposed through the titanium film 24. This may be accomplished in at least two ways. One way is to completely deposit titanium over the entire surface of the membrane 22 and then score the titanium layer to form a groove 25 with removal of the titanium in the groove exposing the base metal area 26. A circular groove 25 is shown in FIG. 2, but other configurations or knurling could be utilized. Another way of providing the area 26 is to mask off a limited area during deposition of the titanium film on the base metal resulting in the groove 25.

Inhibitor release from the container 18 should be as rapid as possible in corrosive fluid so long as no corrosion occurs in the presence of the inhibited ethylene gylcol-water mixture. In addition, release should not be blocked by corrosive aluminum oxide formation. The sputter deposited titanium film decreases the pentration time (increased corrosion rate) of the aluminum alloy membrane in corrosive fluid, with corrosion being accelerated through the galvanic action of the titanium-aluminum couple. Likewise, galvanic corrosion, i.e. the increase in corrosion caused by a galvanic cell, will also occur between other noble metals, such as silver, gold or platinum, and aluminum. In fact, most metals less active than aluminum, such as lead, tin, nickel, copper and alloys of these metals, will accelerate corrosion through galvanic action. Also, inhibitor release is less likely to be blocked by oxide formation when the aluminum membrane is coated with titanium.

Numerous tests have been run using titanium coated aluminum membranes or foil. These tests indicated that a titanium sputter coated aluminum membrane reduced the penetration time when exposed to corrosive water from five or more days to one day or less. Also, all titanium sputter coated aluminum membranes had several areas of complete penetration, but penetration was slower where the titanium deposit was located on the air or inhibitor side of the aluminum membrane. Although sputter coated titanium deposits are discussed, titanium could be deposited by vapor or electrolytic methods.

Figure 4:
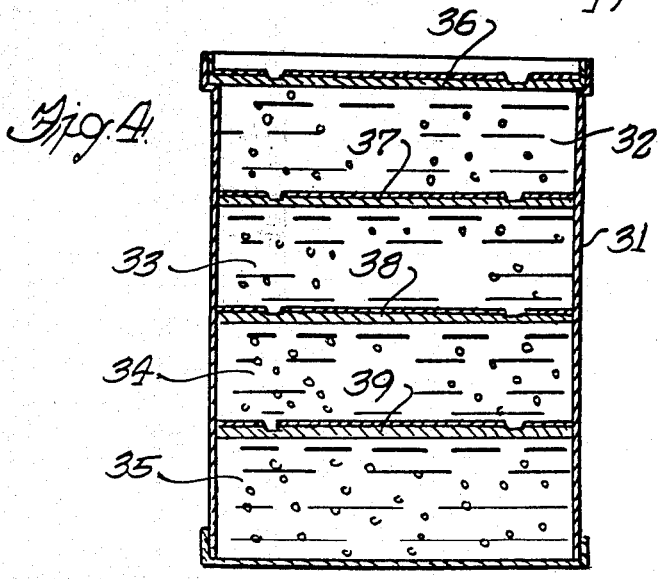
FIG. 4 is a cross sectional view through a multi-partitioned container having several membranes for adding inhibitor charges in sequence.

FIG. 4 discloses a corrosion inhibitor container 31 having several charges 32, 33, 34, 35 of corrosion inhibitor. A titanium sputter coated aluminum membrane 36 closes the end of the container 31 and similar aluminum membrane partitions 37, 38 and 39 are located in the container to separate the various inhibitor charges. This structure will provide for four sequential additions of corrosion inhibitor to the coolant as the corrosive level of the coolant varies during use over a relatively long interval of time.

We claim:

1. A heat exchanger in combination with a container for the automatic addition of a corrosion inhibitor into a circulating fluid system for a heat exchanger subject to corrosion, including a container housing the corrosion inhibitor with a membrane for one end of said container which is in contact with the circulating fluid, said container end comprising a bimetallic membrane having a base metal layer which will corrode when exposed to the circulating fluid in a corrosive condition but will not corrode when the fluid contains a desired concentration of corrosion inhibitor, and a thin film of a second metal comprising titanium formed on the exterior surface of the base layer and exposed to said fluid protecting the base metal when the corrosive condition occurs.

2. A membrane as set forth in claim 1, in which said base metal is an aluminum alloy that is susceptible to corrosion when the inhibitor concentration of the circulating fluid falls below a predetermined level.

3. A membrane as set forth in claim 2, wherein said aluminum alloy base and said titanium film form a galvanic couple when the inhibitor concentration falls below a predetermined level and the aluminum alloy begins to corrode.

4. A membrane as set forth in claim 2, in which said titanium film is sputter coated onto said aluminum alloy.

5. A membrane as set forth in claim 4, in which a limited area of the base metal is masked to prevent deposition of titanium thereon.

6. A membrane as set forth in claim 2, in which said titanium film is scored to penetrate the film and expose a limited area of the base metal.

7. A membrane as set forth in claim 2, in which said titanium film and limited area of base metal is exposed to the flow of circulating fluid.

8. A membrane as set forth in claim 1, in which said thin film exposes a limited area of the base metal to the circulating fluid.

* * * * *